US005831940A

United States Patent [19]

Gillette

[11] Patent Number: 5,831,940

[45] Date of Patent: Nov. 3, 1998

[54] SOLO ELECTRONIC STARTER AND TIMER SYSTEM

[76] Inventor: Warren Gillette, 14795 N. 78th Way, # 700, Scottsdale, Ariz. 85260

[21] Appl. No.: 924,774

[22] Filed: Aug. 27, 1997

[51] Int. Cl.[6] ..... G04F 8/00; G04F 10/00; G08B 23/00

[52] U.S. Cl. ..... 368/3; 368/9; 368/113; 340/323 R

[58] Field of Search ..... 368/319, 10, 107, 368/110–113; 340/323 R, 600; 377/5, 53

[56] References Cited

U.S. PATENT DOCUMENTS

| | | | |
|---|---|---|---|
| 3,502,009 | 3/1970 | Connors | 95/1.1 |
| 3,596,103 | 7/1971 | Matthews | 250/221 |
| 4,456,383 | 6/1984 | Speckhart et al. | 368/9 |
| 4,523,204 | 6/1985 | Bovay | 346/107 B |
| 4,643,585 | 2/1987 | Hillesland | 368/9 |
| 4,752,764 | 6/1988 | Peterson et al. | 340/323 R |
| 4,823,367 | 4/1989 | Kreutzfeld | 377/24.2 |
| 5,103,433 | 4/1992 | Imhof | 368/9 |
| 5,105,395 | 4/1992 | Imhof | 368/9 |
| 5,140,307 | 8/1992 | Bebetez et al. | 340/539 |
| 5,436,611 | 7/1995 | Arlinghaus, Jr. | 340/323 R |

*Primary Examiner*—Vit W. Miska
*Attorney, Agent, or Firm*—Joseph N. Breaux

[57] ABSTRACT

A solo electronic starter and timer system for runners that includes a starter position unit, a finish position unit, and an athlete body unit; the body unit radio transmitter circuit transmitting a stop pulse to the finish position unit in response to the triggering of the body unit radio transmitter control circuit triggered by an optical body unit photo detector circuit; the finish position unit having a micro-controller programmed to time and display the elapsed time between receipt of start pulse by a radio receiver circuit of the finish position unit and receipt of the stop pulse that is generated by the body unit radio transmitter circuit of the athlete body unit.

1 Claim, 2 Drawing Sheets

SOLO ELECTRONIC STARTER AND TIMER SYSTEM

TECHNICAL FIELD

The present invention relates to starting and timing devices used for starting and timing track events and practice sessions and more particularly to a solo electronic starter and timer system that includes a starter position unit, a finish position unit, and an athlete body unit; and wherein the starter position unit has a speaker and a starter unit radio transmitter that are each controlled by a starter unit micro-controller IC, a sequence select switch in connection with the starter unit micro-controller IC being positionable by a user in one of two predetermined switch positions, a reset timing sequence switch in connection with the starter unit micro-controller IC, a reset finish position unit switch in connection with the starter unit micro-controller IC, the starter unit micro-controller generating a starting sequence count after the starter unit sequence reset switch is depressed, the starting sequence count including a selectable first predetermined delay period for getting into the starting blocks, a first randomized delay period following the first predetermined delay period, and a second randomized delay period following the first randomized delay period; the finish position unit including a finish unit radio receiver circuit tuned to receive the timer start pulse from the starter unit radio transmitter, a finish unit antenna in connection with the finish unit radio receiver circuit, a finish unit micro-controller IC, a time display assembly in connection with the finish unit micro-controller IC, a finish unit clock reset switch in connection with the finish unit micro-controller, a finish unit sequence reset switch in connection with the finish unit micro-controller, and an optical finish line emitter in connection with the finish unit micro-controller and having a focusing cone for shaping the optical output of the optical finish line emitter into a pie shaped optical finish line; the athlete body unit including an optical body unit photo detector circuit tuned to detect the optical characteristics of the optical output of the optical finish line emitter, a body unit radio transmitter control circuit triggered by the optical body unit photo detector circuit, and a body unit radio transmitter circuit having a body unit transmitting antenna; the body unit radio transmitter circuit transmitting a stop pulse in response to the triggering of the body unit radio transmitter control circuit triggered by the optical body unit photo detector circuit; the finish unit micro-controller being programmed to time and display the elapsed time between receipt of the start pulse by the radio receiver circuit of the finish position unit and receipt of the stop pulse that is generated by the body unit radio transmitter circuit of the athlete body unit; the first predetermined delay period being selected from the two preprogrammed predetermined delay time periods by positioning the sequence select switch into one of the two predetermined switch positions, the end of the first predetermined delay period being signaled by a first audible output signal from the speaker to indicate "come to your mark"; the first randomized delay period ending in a second audible output from the speaker signaling "get set"; the second randomized delay period ending in a third audible output from the speaker signaling "go" and a simultaneous transmission of a timer start pulse from the starter unit radio transmitter.

BACKGROUND OF THE INVENTION

It can often be difficult for solo sprinters to accurately time themselves during solo practice sessions. It would be a benefit, therefore, to have a timing device that included an electronic finish line that could detect when the runner crossed the finish line and stop a timer. Because it may be desirable to allow the user to position the electronic finish line above the track level, it would be a further benefit to have a timing device with an adjustable height electronic finish line. In addition, because one of the important aspects of successful sprinting is getting out of the blocks rapidly after the starting gun is sounded, it would be a further benefit to have a starter system for solo practice sessions that included a starter position unit that outputs an audible and randomly delayed starting signal while simultaneously starting an elapsed timing circuit. It would of course further be desirable to have a combined solo electronic starter and timer system that is easily carried in an athlete's gym bag.

SUMMARY OF THE INVENTION

It is thus an object of the invention to provide a solo electronic timing device that includes an electronic finish line that detects crossing of the finish line by a runner and simultaneously stops a timer circuit.

It is a further object of the invention to provide a solo electronic timing device that includes an adjustable height electronic finish line.

It is a still further object of the invention to provide a solo electronic starter that includes a starter position unit that outputs an audible and randomly delayed starting signal while simultaneously starting an elapsed timing circuit.

It is a still further object of the invention to provide a combined solo electronic starter and timer system.

It is a still further object of the invention to provide a solo electronic starter and timer system that includes a starter position unit, a finish position unit, and an athlete body unit; and wherein the starter position unit has a speaker and a starter unit radio transmitter that are each controlled by a starter unit micro-controller IC, a sequence select switch in connection with the starter unit micro-controller IC being positionable by a user in one of two predetermined switch positions, a reset timing sequence switch in connection with the starter unit micro-controller IC, a reset finish position unit switch in connection with the starter unit micro-controller IC, the starter unit micro-controller generating a starting sequence count after the starter unit sequence reset switch is depressed, the starting sequence count including a selectable first predetermined delay period for getting into the starting blocks, a first randomized delay period following the first predetermined delay period, and a second randomized delay period following the first randomized delay period; the finish position unit including a finish unit radio receiver circuit tuned to receive the timer start pulse from the starter unit radio transmitter, a finish unit antenna in connection with the finish unit radio receiver circuit, a finish unit micro-controller IC, a time display assembly in connection with the finish unit micro-controller IC, a finish unit clock reset switch in connection with the finish unit micro-controller, a finish unit sequence reset switch in connection with the finish unit micro-controller, and an optical finish line emitter in connection with the finish unit micro-controller and having a focusing cone for shaping the optical output of the optical finish line emitter into a pie shaped optical finish line; the athlete body unit including an optical body unit photo detector circuit tuned to detect the optical characteristics of the optical output of the optical finish line emitter, a body unit radio transmitter control circuit triggered by the optical body unit photo detector circuit, and a body unit radio transmitter circuit having a body unit transmitting antenna; the body unit radio transmitter circuit transmitting a stop pulse in response to the triggering of the body unit radio transmitter control circuit triggered by the optical body unit photo detector circuit; the finish unit micro-controller being programmed to time and display the elapsed time between receipt of the start pulse by the radio receiver circuit of the finish position unit and receipt of the stop pulse that is generated by the body unit radio transmitter circuit of the athlete body unit; the first predetermined delay period being selected from the two preprogrammed predetermined delay time periods by positioning the sequence select switch into one of the two predetermined switch positions, the end of the first predetermined delay period being signaled by a first audible output signal from the speaker to indicate "come to your mark"; the first randomized delay period ending in a second audible output from the speaker signaling "get set"; the second randomized delay period ending in a third audible output from the speaker signaling "go" and a simultaneous transmission of a timer start pulse from the starter unit radio transmitter.

It is a still further object of the invention to provide a solo electronic starter and timer system that accomplishes some or all of the above objects in combination.

Accordingly, a solo electronic starter and timer system is provided. The solo electronic starter and timer system includes a starter position unit, a finish position unit, and an athlete body unit; and wherein the starter position unit has a speaker and a starter unit radio transmitter that are each controlled by a starter unit micro-controller IC, a sequence select switch in connection with the starter unit micro-controller IC being positionable by a user in one of two predetermined switch positions, a reset timing sequence switch in connection with the starter unit micro-controller IC, a reset finish position unit switch in connection with the starter unit micro-controller IC, the starter unit micro-controller generating a starting sequence count after the starter unit sequence reset switch is depressed, the starting sequence count including a selectable first predetermined delay period for getting into the starting blocks, a first randomized delay period following the first predetermined delay period, and a second randomized delay period following the first randomized delay period; the finish position unit including a finish unit radio receiver circuit tuned to receive the timer start pulse from the starter unit radio transmitter, a finish unit antenna in connection with the finish unit radio receiver circuit, a finish unit micro-controller IC, a time display assembly in connection with the finish unit micro-controller IC, a finish unit clock reset switch in connection with the finish unit micro-controller, a finish unit sequence reset switch in connection with the finish unit micro-controller, and an optical finish line emitter in connection with the finish unit micro-controller and having a focusing cone for shaping the optical output of the optical finish line emitter into a pie shaped optical finish line; the athlete body unit including an optical body unit photo detector circuit tuned to detect the optical characteristics of the optical output of the optical finish line emitter, a body unit radio transmitter control circuit triggered by the optical body unit photo detector circuit, and a body unit radio transmitter circuit having a body unit transmitting antenna; the body unit radio transmitter circuit transmitting a stop pulse in response to the triggering of the body unit radio transmitter control circuit triggered by the optical body unit photo detector circuit; the finish unit micro-controller being programmed to time and display the elapsed time between receipt of the start pulse by the radio receiver circuit of the finish position unit and receipt of the stop pulse that is generated by the body unit radio transmitter circuit of the athlete body unit; the first predetermined delay period being selected from the two preprogrammed predetermined delay time periods by positioning the sequence select switch into one of the two predetermined switch positions, the end of the first predetermined delay period being signaled by a first audible output signal from the speaker to indicate "come to your mark"; the first randomized delay period ending in a second audible output from the speaker signaling "get set"; the second randomized delay period ending in a third audible output from the speaker signaling "go" and a simultaneous transmission of a timer start pulse from the starter unit radio transmitter.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
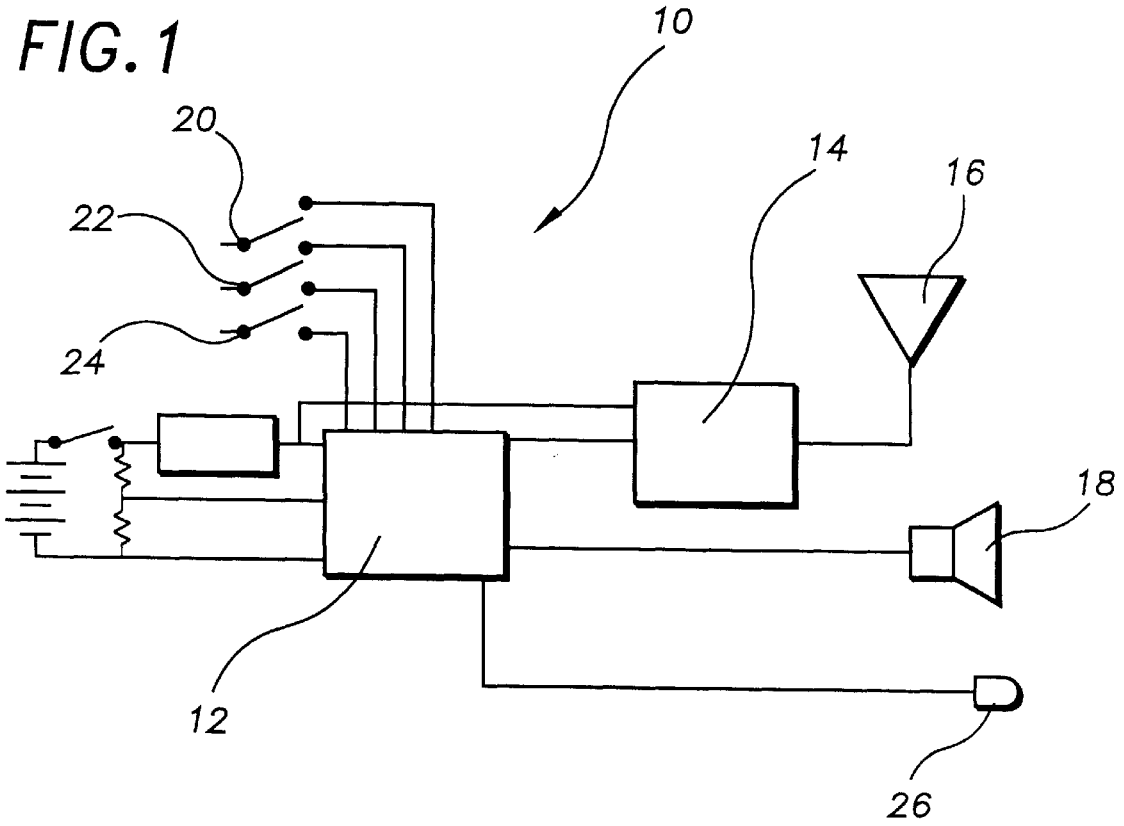
FIG. 1 is a schematic diagram of an exemplary embodiment of the starter position unit of the solo electronic starter and timer system of the present invention showing the starter unit micro-controller IC; the starter unit radio transmitter circuit; the starter unit antenna; the speaker assembly; the starter unit clock reset switch; the starter unit sequence reset switch; the finish unit reset switch; and the starter unit low battery indicator diode.

FIG. 1 is a schematic diagram of a first exemplary embodiment of the starter position unit of the solo electronic starter and timer system of the present invention generally designated by the numeral 10. In this embodiment, starter position unit 10 includes a starter unit micro-controller IC 12; a starter unit radio transmitter circuit 14; a starter unit antenna 16; a speaker assembly 18; a starter unit sequence select switch 20; a starter unit clock reset switch 20; a finish unit reset switch 24; and a starter unit low battery indicator diode 26.

Figure 2A:
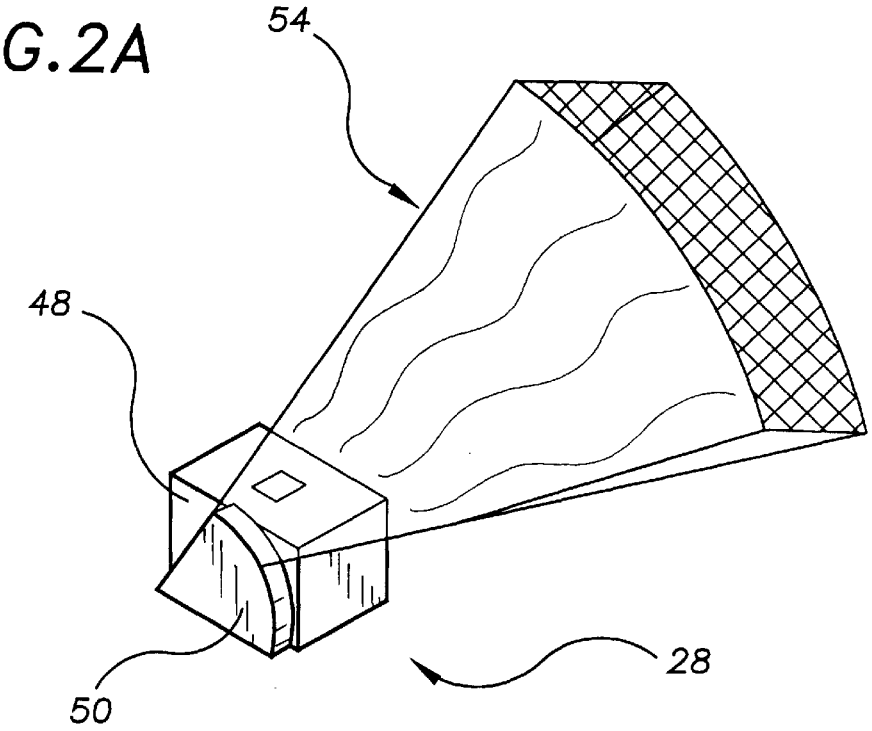
FIG. 2A is a perspective view of a finish unit housing of the solo electronic starter and timer system of the present invention showing the time display and the focusing cone of the optical finish line emitter showing the pie shaped optical finish line emitted by the optical finish line emitter and shaped by the focusing cone.
Figure 2:
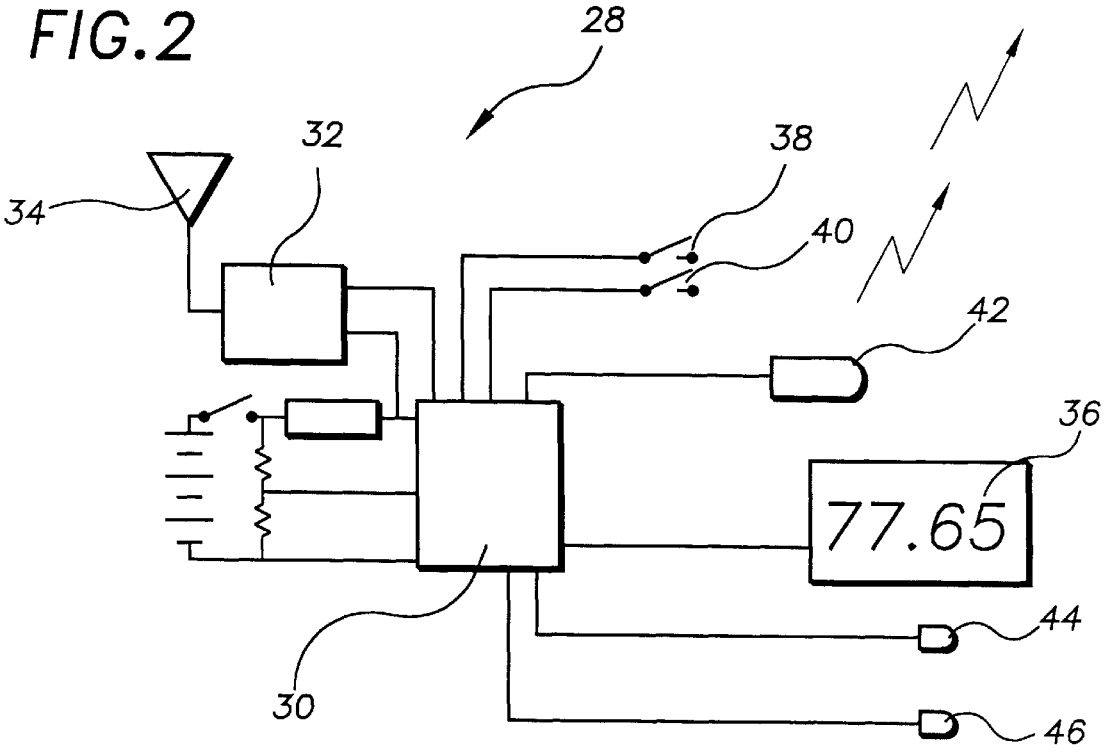
FIG. 2 is a schematic diagram of an exemplary embodiment of the finish position unit of the solo electronic starter and timer system of the present invention showing finish unit micro-controller IC; the finish unit radio receiver circuit; the finish unit antenna; the time display assembly; the finish unit clock reset switch; the finish unit sequence reset switch; an optical finish line emitter; the finish unit low battery indicator diode; and the finish unit ready indicator diode.

FIG. 2 shows a schematic diagram of an exemplary embodiment of the finish position unit of the solo electronic starter and timer system of the present invention generally designated by the numeral 28. In this embodiment, finish position unit 28 includes a finish unit micro-controller IC 30; a finish unit radio receiver circuit 32; a finish unit antenna 34; a liquid crystal time display assembly 36; a finish unit clock reset switch 38; a finish unit sequence reset switch 40; an optical finish line emitter 42; a finish unit low battery indicator diode 44; and a finish unit ready indicator diode 46.

FIG. 2A shows a finish unit housing 48 of finish position unit 28 showing liquid crystal time display assembly 36 and a focusing cone 50 for shaping and focusing the optical output from optical finish line emitter 42 (FIG. 2) into a pie shaped optical finish line, generally designated 54.

Figure 3:
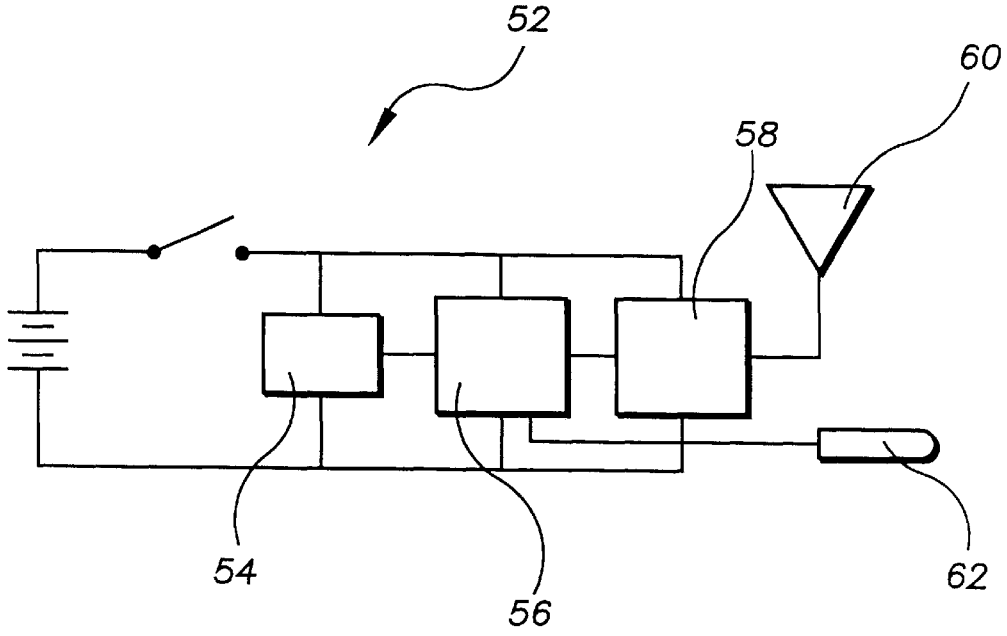
FIG. 3 is a schematic diagram of the athlete body unit of the solo electronic starter and timer system of the present invention showing the optical body unit photo detector circuit; the body unit radio transmitter control circuit; the body unit radio transmitter circuit; the body unit transmitting antenna; and the body unit low battery indicator diode.

FIG. 3 shows a schematic diagram of an exemplary embodiment of the athlete body unit of the solo electronic starter and timer system of the present invention generally designated 52. In this embodiment, athlete body unit 52 includes an optical body unit photo detector circuit 54; a body unit radio transmitter control circuit 56; a body unit radio transmitter circuit 58; a body unit transmitting antenna 60; and a body unit low battery indicator diode 62.

With general reference to FIGS. 1–3, in use a user sets starter position unit 10 near the starting line, sets the finish position unit 28 adjacent to the desired finish line in a manner such that optical finish line emitter 42 and focusing cone 50 provide a pie shaped optical finish line across the desired finish line, and attaches the athlete body unit 52 to his/her headband, waistband or other desired body area. The user then returns to starter position unit 10 and selects the desired starting sequence by positioning the two position starter unit sequence select switch 20 in the corresponding predetermined switch position and then rapidly entering the starting blocks. Operation of the solo electronic starter and timer system of the present invention is then automatic and as previously described.

It can be seen from the preceding description that a solo electronic timing device has been provided that includes an electronic finish line that detects crossing of the finish line by a runner and simultaneously stops a timer circuit; that includes an adjustable height electronic finish line; that includes a starter position unit that outputs an audible and randomly delayed starting signal while simultaneously starting an elapsed timing circuit; and that includes a starter position unit, a finish position unit, and an athlete body unit; and wherein the starter position unit has a speaker and a starter unit radio transmitter that are each controlled by a starter unit micro-controller IC, a sequence select switch in connection with the starter unit micro-controller IC being positionable by a user in one of two predetermined switch positions, a reset timing sequence switch in connection with the starter unit micro-controller IC, a reset finish position unit switch in connection with the starter unit micro-controller IC, the starter unit micro-controller generating a starting sequence count after the starter unit sequence reset switch is depressed, the starting sequence count including a selectable first predetermined delay period for getting into the starting blocks, a first randomized delay period following the first predetermined delay period, and a second randomized delay period following the first randomized delay period; the finish position unit including a finish unit radio receiver circuit tuned to receive the timer start pulse from the starter unit radio transmitter, a finish unit antenna in connection with the finish unit radio receiver circuit, a finish unit micro-controller IC, a time display assembly in connection with the finish unit micro-controller IC, a finish unit clock reset switch in connection with the finish unit micro-controller, a finish unit sequence reset switch in connection with the finish unit micro-controller, and an optical finish line emitter in connection with the finish unit micro-controller and having a focusing cone for shaping the optical output of the optical finish line emitter into a pie shaped optical finish line; the athlete body unit including an optical body unit photo detector circuit tuned to detect the optical characteristics of the optical output of the optical finish line emitter, a body unit radio transmitter control circuit triggered by the optical body unit photo detector circuit, and a body unit radio transmitter circuit having a body unit transmitting antenna; the body unit radio transmitter circuit transmitting a stop pulse in response to the triggering of the body unit radio transmitter control circuit triggered by the optical body unit photo detector circuit; the finish unit micro-controller being programmed to time and display the elapsed time between receipt of the start pulse by the radio receiver circuit of the finish position unit and receipt of the stop pulse that is generated by the body unit radio transmitter circuit of the athlete body unit; the first predetermined delay period being selected from the two preprogrammed predetermined delay time periods by positioning the sequence select switch into one of the two predetermined switch positions, the end of the first predetermined delay period being signaled by a first audible output signal from the speaker to indicate "come to your mark"; the first randomized delay period ending in a second audible output from the speaker signaling "get set"; the second randomized delay period ending in a third audible output from the speaker signaling "go" and a simultaneous transmission of a timer start pulse from the starter unit radio transmitter.

It is noted that the embodiment of the solo electronic starter and timer system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A solo electronic starter and timer system comprising:

a starter position unit including a starter unit micro-controller IC, a starter unit radio transmitter controlled by said starter unit micro-controller IC, a speaker controlled by said starter unit micro-controller IC, a sequence select switch in connection with said starter unit micro-controller IC that is positionable by a user in one of two predetermined switch positions, a reset timing sequence switch in connection with said starter unit micro-controller IC, a reset finish position unit switch in connection with said starter unit micro-controller IC, said starter unit micro-controller generating a starting sequence count after said starter unit sequence reset switch is depressed, said starting sequence count including a selectable first predetermined delay period for getting into said starting blocks, a first randomized delay period following said first predetermined delay period, and a second randomized delay period following said first randomized delay period;

a finish position unit including a finish unit radio receiver circuit tuned to receive said timer start pulse from said starter unit radio transmitter, a finish unit antenna in connection with said finish unit radio receiver circuit, a finish unit micro-controller IC, a time display assembly in connection with said finish unit micro-controller IC, a finish unit clock reset switch in connection with said finish unit micro-controller, a finish unit sequence reset switch in connection with said finish unit micro-controller, and an optical finish line emitter in connection with said finish unit micro-controller and having a focusing cone for shaping said optical output of said optical finish line emitter into a pie shaped optical finish line; and an athlete body unit including an optical body unit photo detector circuit tuned to detect said optical characteristics of said optical output of said optical finish line emitter, a body unit radio transmitter control circuit triggered by said optical body unit photo detector circuit, and a body unit radio transmitter circuit having a body unit transmitting antenna;

said body unit radio transmitter circuit transmitting a stop pulse in response to said triggering of said body unit radio transmitter control circuit triggered by said optical body unit photo detector circuit;

said finish unit micro-controller being programmed to time and display said elapsed time between receipt of said start pulse by said radio receiver circuit of said finish position unit and receipt of said stop pulse that is generated by said body unit radio transmitter circuit of said athlete body unit;

said first predetermined delay period being selected from said two preprogrammed predetermined delay time periods by positioning said sequence select switch into one of said two predetermined switch positions, said end of said first predetermined delay period being signaled by a first audible output signal from said speaker to indicate "come to your mark";

said first randomized delay period ending in a second audible output from said speaker signaling "get set";

said second randomized delay period ending in a third audible output from said speaker signaling "go" and a simultaneous transmission of a timer start pulse from said starter unit radio transmitter.

* * * * *